United States Patent [19]

Anderson

[11] Patent Number: 4,942,716

[45] Date of Patent: Jul. 24, 1990

[54] ASEPTIC FILLING MACHINE

[75] Inventor: Ian M. Anderson, Sandringham, Australia

[73] Assignee: Courtaulds Packaging Australia Limited, Australia

[21] Appl. No.: 123,096

[22] Filed: Nov. 20, 1987

[30] Foreign Application Priority Data

Nov. 21, 1986 [AU] Australia ..... PH09089

[51] Int. Cl.[5] ..... B65B 55/08; B65B 55/10; B65B 43/26; B65B 7/02

[52] U.S. Cl. ..... 53/426; 53/452; 53/468; 53/479; 53/558; 53/570; 53/373; 53/381 R; 53/381 A

[58] Field of Search ..... 53/425, 426, 468, 469, 53/473, 479, 268, 275, 381 A, 109, 267, 312, 452, 558, 570, 373, 381 R

[56] References Cited

U.S. PATENT DOCUMENTS

| | | | |
|---|---|---|---|
| 2,761,603 | 9/1956 | Fairchild | 53/510 |
| 2,930,170 | 3/1960 | Holsman et al. | 53/268 |
| 3,245,200 | 4/1966 | Shaw . | |
| 3,578,038 | 5/1971 | Burford . | |
| 3,824,762 | 7/1974 | Walles . | |
| 3,926,229 | 12/1975 | Scholle . | |
| 4,077,182 | 3/1978 | Papaluca | 53/109 |
| 4,120,134 | 10/1978 | Scholle . | |
| 4,257,535 | 3/1981 | Mellett | 53/479 |
| 4,283,901 | 8/1981 | Schieser et al. . | |
| 4,360,996 | 11/1982 | Rutter | 53/469 |
| 4,519,184 | 5/1985 | Brunswick | 53/512 |
| 4,524,563 | 6/1985 | Sassi | 53/268 |

FOREIGN PATENT DOCUMENTS

| | | |
|---|---|---|
| 0026055 | 4/1981 | European Pat. Off. . |
| 2919388 | 11/1979 | Fed. Rep. of Germany . |
| 3032404 | 3/1981 | Fed. Rep. of Germany . |
| 1129600 | 10/1968 | United Kingdom . |
| 1194332 | 6/1970 | United Kingdom . |

*Primary Examiner*—Horace M. Culver
*Attorney, Agent, or Firm*—Bell, Seltzer, Park & Gibson

[57] ABSTRACT

An aseptic system and filling head wherein the container is presterilized and has a rupturable membrane over the inlet which membrane is broken by the filling machine prior to filling. The membrane may be a laminate which is broken by pressure of the product with which the container is to be filled. In that case the outermost layer of the laminate is dissolved prior to the filling step to weaken the membrane. Alternatively the membrane may be pierced by a reciprocating tool which also functions as a valve member in the filling head or by a fixed blade arranged around the outlet nozzle of the filling head.

7 Claims, 3 Drawing Sheets

ASEPTIC FILLING MACHINE

This invention relates to improved means for operating an aseptic filling machine.

European patent specifications 072699 and 236107 disclose a system for aseptic filling of flexible packages in which pre-sterilized flexible containers incorporate a rupturable membrane closing the product inlet and the filling machine incorporates means to puncture the membrane and means to sterilize the external surface of the membrane and the surfaces of the filling nozzle and puncturing means past which product flows. This had the advantage of only requiring a small area of contact between the filling nozzle and the flexible container to be sterilized.

In the commercial embodiment the valve member also doubled as the puncturing means and thus had three basic positions—(1) open, (2) closed, (3) closed and extended to puncture the rupturable membrane of the flexible container. To seal the outlet an "o" ring seal was used which sealed against the valve member. An alternative is to use a valve seat for sealing but where a valve seat is provided, additional movement to puncture the rupturable membrane is prevented.

It is an object of this invention to provide alternative means of providing a valve seal and alternative means for rupturing the membrane.

One solution is to rely on product pressure to rupture the membrane and simply use a valve seat to provide the seal for the dispensing nozzle. In order to improve the performance of the rupturable seal this invention provides a rupturable membrane comprising a laminate of a film forming material soluble in a sterilizing fluid and a second film forming material which is non-soluble in the sterilizing fluid.

After the flexible container is brought into contact with the filling head, sterilizing fluid is introduced into the space between the membrane and the valve closure. This will dissolve the soluble upper layer of the laminate leaving a more easily ruptured membrane to be broken by product flow when the valve is opened. When steam the preferred sterilizing fluid, a polyvinyl alcohol file layer can be used as the steam soluble layer and polyethylene as the co-laminate.

To this end the present invention provides a system for aseptically filling and storing degradable liquid contents which comprises:

(a) a flexible container having an inlet, said inlet being capable of being sealed by heat sealing and incorporating over its inlet opening a rupturable closure comprising a membrane which incorporates a layer which is soluble in a sterilizing fluid;

(b) a fluid dispenser which incorporates a sterilizable product conduit comprising (i) two openings for allowing ingress or egress of degradable liquid contents (ii) one of said openings being adapted to abut a container inlet (iii) a valve member adapted for reciprocal movement within said conduit for closing the other of said openings (iv) a valve seat about said ingress opening providing a seal with said valve member (v) at least one sterilizing fluid inlet and at least one sterilizing fluid outlet opening onto said conduit adjacent the opening which abuts the container inlet, (c) means for sterilizing the containers while closed with said rupturable closure;

(d) container support means for bringing said container inlet into engagement with said filling head such that said recess is closed by said rupturable closure;

(e) means for injecting said sterilizing fluid into said recess to sterilize the recess and remove said soluble membrane;

(f) means to actuate said valve to allow liquid to pass through said recess, rupture said membrane and fill said container; and (g) heat sealing means located external to said fixed filling head.

Another means of rupturing the membrane without relying on extension of the valve member is to provide perforating means about the periphery of the filling nozzle to weaken the membrane. This perforation step must take place after the sterilization step and therefor the support means for the flexible container needs to lift or press the membrane toward the perforating means. This can be achieved by ensuring sufficient resilience in the seal between the container spout and the filling head.

One means of providing such resilience is to use a biassed seal mounted on the filling heads which provides a seal about the container's rupturable membrane. The biassing can be provided by a spring or preferably by hydraulic or pneumatic pressure from a sterilizing fluid such as steam. This last proposal has the advantage of keeping the seal in a constant sterile condition.

A further proposal is to provide an extendible puncturing tool within the valve member. This puncturing tool could be electro-magnetically propelled within a cylinder inside the valve member.

In each of the above suggestions the valve member seals on a valve seat which prevents its further movement toward the spout of the container. Movement of the valve member away from the spout opens the product outlet.

An alternative valve arrangement is to provide for a valve member and a valve seat for sealing in which the valve member carries a membrane puncturing tool and moves toward the container spout to open the product outlet. Thus in puncturing the membrane the product outlet of the filling head is also opened.

To this end the present invention provides a system for aseptically filling and storing degradable liquid contents which comprises:

(a) a flexible container having a sealed inlet, said inlet being capable of being opened and resealed;

(b) a fluid dispenser which incorporates a sterilizable product conduit comprising (i) two openings for allowing ingress or egress of degradable liquid contents (ii) one of said openings being adapted to abut a container inlet (iii) a valve member adapted for reciprocal movement between said openings for opening and closing the other of said openings and sealingly engaging the side of said other opening facing said one opening (iv) said valve member carrying means for opening said container inlet (v) at least one sterilizing fluid inlet and at least one sterilizing fluid outlet opening onto said conduit adjacent the opening which abuts the container inlet (c) means for sterilizing the containers while said inlet is closed;

(d) container support means for bringing said container inlet into engagement with said filling head such that said conduit is closed by the (e) means for injecting said sterilizing fluid into said conduit between said openings;

(f) means to actuate said valve member to open said other opening and to open said container inlet and allow liquid product to fill said container; and (g) means located external to said fixed fillinghead to reseal said inlet.

This invention will now be further described with reference to the drawings.

FIG. 1 is a schematic depiction of the filling head according to European specification No. 236107, corresponds to U.S. Pat. No. 4,805,378.

Figure 1:
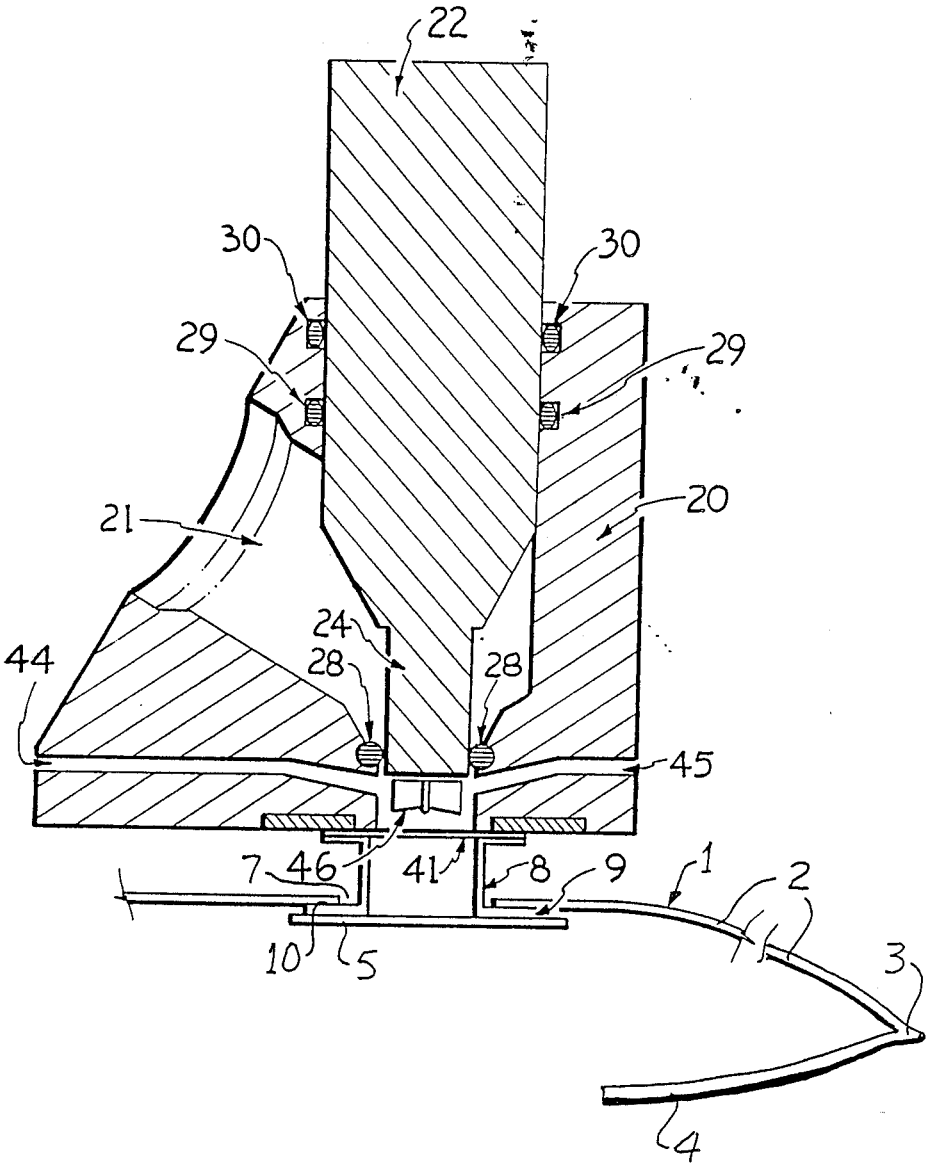

Referring to FIG. 1, the bag—generally designated as 1—comprises a wall 2 heat sealed at the periphery 3 to the lower wall 4. The flap 5 extends across an opening 7 in the flexible container wall 2 into which fits a collar 8. The flange 9 of collar 8 is heat sealed to the periphery 10 of the opening and the flap 5 is partly sealed to the flange of collar 8. As mentioned above the collar 8 can easily be secured to wall 2 by suitable machinery. The surface of flap 5 which faces the internal surface of wall 4 is non heat sealable therewith but the surface of flap 5 which faces flange 9 is heat sealable with that flange. Preferably flap 5 is a laminate of a heat sealable and a non heat sealable material.

Across the outer opening of collar 8 is a rupturable membrane 41 which is either integrally formed during the moulding of collar 8 or is heat sealed thereto. Apart from the membrane 41 the container and collar is as described in U.S. Pat. No. 4,257.535.

The filling apparatus is similar to that described in European patent specifications 072699 and 236107.

The filling head comprises a general body section 20 which includes a liquid inlet channel 21 closed by the valve member 22. The valve member 22 extends within the body section 20. The valve member 22 includes a valve head 24 which seals the outlet when in contact with the o-ring seal 28. A piercing tool 46 is attached to the lower portion of the valve head 24.

When the valve member 22 is in its closed position the liquid outlet channel 21 is sealed and the seals 28, 29 and 30 ensure that no liquid can escape once the valve member 22 is closed.

The sterilizing fluid inlet 44 and outlet 45 are connected to the nozzle recess 46 below the valve head 24. The number of inlets 44 and outlets 45 can be varied and by positioning several inlets tangentially about the periphery of recess 46 an efficient cleaning action can be achieved. One large exhaust port 45 is usually sufficient.

Figure 2:
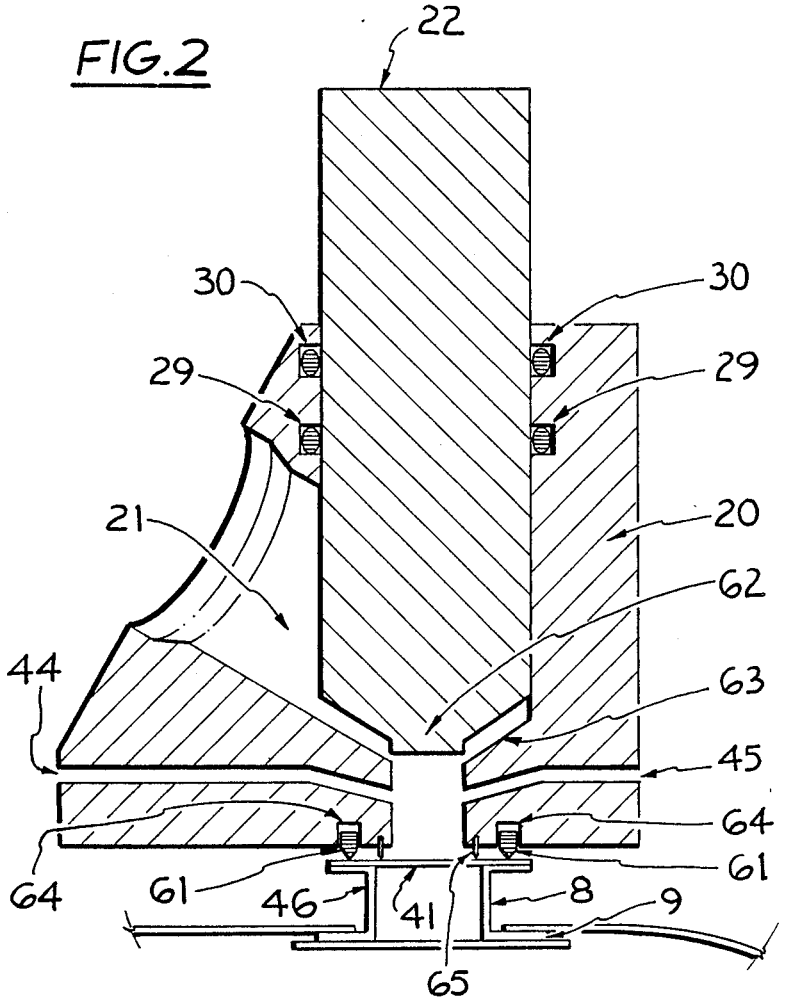
FIG. 2 is an illustration of a cross-section of a filling head where the seal between the spout and filling head is resiliently biassed to allow the member to be lifted to allow puncturing of the membrane.

In FIG. 2 the collar 8 and membrane 41 sealingly engage the resilient seal 61 of the filling head 20. In this embodiment the valve member 62 seats on valve seat 63 above the sterilizing fluid inlet 44 and outlet 45. The perforation blade 65 is positioned to enable it to perforate the membrane 41 along a line which allows a hinged flap to be formed when product breaks the perforation and enters the flexible container.

The seal 61 can be biassed by a spring in the seal recess 64 or by pressure from sterilizing fluid fed to the recess 64. By release of pressure in recess 64 the membrane 41 can be raised to engage the perforation blade 65.

Figure 3:
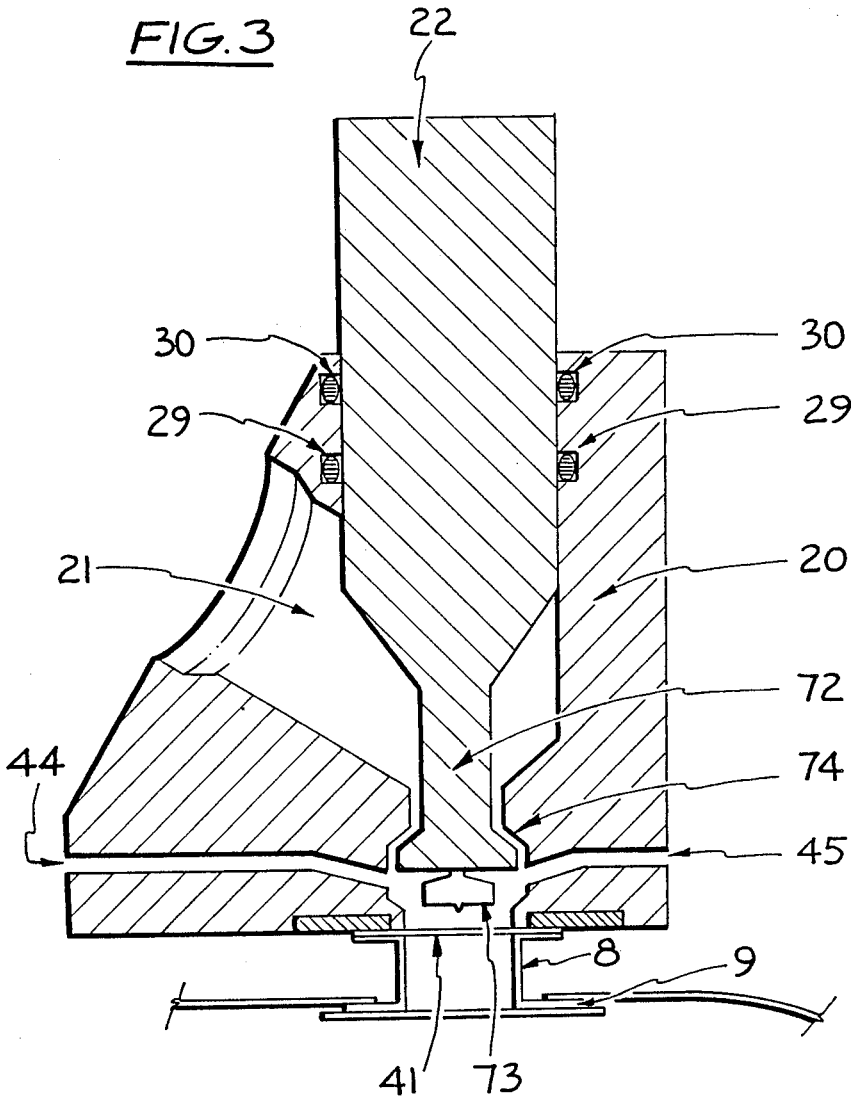
FIG. 3 is an illustration of the valve seat where the valve member moves toward the container spout to open the product outlet.

The embodiment of FIG. 3 illustrates a modified filling head wherein the product outlet valve comprises valve member 72 and valve seat 74 which is located on the external face of the outlet. The valve member 72 carries on its outer end a puncturing tool 73. After the initial sterilization step the membrane 41 is punctured simultaneously with the opening of the product outlet valve.

From the above it can be seen that difficulties in providing a suitable outlet seal in conjunction with a means for rupturing the temporary membrane seal on the container are overcome with the present invention.

I claim:

1. A system for aseptically filling and storing degradable liquid contents which comprises:

(a) a flexible container having a sealed inlet, said inlet being capable of being opened and resealed;

(b) a fluid dispenser which incorporates a sterilizable product conduit comprising (i) two openings for allowing ingress and egress of degradable liquid contents (ii) one of said openings being adapted to abut a container inlet (iii) a valve member adapted for reciprocal movement within said conduit for closing the other of said openings (iv) at least one sterilizing fluid inlet and at least one sterilizing fluid outlet opening onto said conduit adjacent the opening which abuts the container inlet, (c) container support means for bringing said container inlet into engagement with said filling head such that said recess is closed by the container inlet;

(d) means for injecting said sterilizing fluid into said recess;

(e) means located about the periphery of said one opening to open said container inlet;

(f) means to actuate said valve to allow liquid to pass through said recess, and fill said container; and (g) means located external to said fixed filling head to reseal said inlet.

2. A system as claimed in claim 1 in which the said one opening has a peripheral resilient seal extending downwardly to sealingly engage the sealed inlet of said container and perforating or cutting means located radially inwardly of said resilient seal.

3. A method of aseptically filling containers characterized in the steps of:

(a) maintaining the internal surfaces of the filling dispenser in a sterile state;

(b) bringing the closed inlet of the container into abutment with the outlet nozzle of the filling dispenser by means of a movable container support;

(c) introducing sterilizing fluid into the space between said nozzle and said closed inlet in a direction laterally of product flow from said outlet nozzle into said container inlet and withdrawing it laterally to sterilize the space and dissolve said soluble membrane layer;

(d) actuating said filling dispenser to rupture said membrane and fill said container;

(e) closing said inlet by heat sealing;
(f) introducing sterilizing fluid into the space between said nozzle and said closed inlet and withdrawing it;
(g) removing said container from said dispenser.

4. A system for aseptically filling and storing degradable liquid contents which comprises:
(a) a flexible container having an inlet, said inlet being capable of being sealed by heat sealing and incorporating over its inlet opening a rupturable closure comprising a membrane which incorporates a layer which is soluble in a sterilizing fluid;
(b) a fluid dispenser which incorporates a sterilizable product conduit comprising
  (i) two openings for allowing ingress and egress of degradable liquid contents
  (ii) one of said openings being adapted to abut a container inlet
  (iii) a valve member adapted for reciprocal movement within said conduit for closing the other of said openings
  (iv) a valve seat about said ingress opening providing a seal with said valve member
  (v) at least one sterilizing fluid inlet and at least one sterilizing fluid outlet opening onto said conduit adjacent the opening which abuts the container inlet,
(c) container support means for bringing said container inlet into engagement with said filling head such that said recess is closed by said rupturable closure;
(d) means for injecting said sterilizing fluid into said recess to sterilize the recess and remove said soluble membrane;
(e) means to actuate said valve to allow liquid to pass through said recess, rupture said membrane and fill said container; and
(f) heat sealing means located external to said fixed filling head.

5. A system as claimed in claim 4 in which the sterilizing fluid is steam and the membrane comprises a laminate the exposed layer of which is steam soluble.

6. A system for aseptically filling and storing degradable liquid contents which comprises:
(a) a flexible container having a sealed inlet, said inlet being capable of being opened and resealed;
(b) a fluid dispenser which incorporates a sterilizable product conduit comprising
  (i) two openings for allowing ingress and egress of degradable liquid contents
  (ii) one of said openings being adapted to abut a container inlet
  (iii) a valve member adapted for reciprocal movement between said openings for opening and closing the other of said openings and sealingly engaging the side of said other opening facing said one opening
  (iv) said valve member carrying means for opening aid container inlet
  (v) at least one sterilizing fluid inlet and at least one sterilizing fluid outlet opening onto said conduit adjacent the opening which abuts the container inlet
(c) container support means for bringing said container inlet into engagement with said filling head such that said conduit is closed by the container inlet;
(d) means for injecting said sterilizing fluid into said conduit between said openings;
(e) means to actuate said valve member to open said other opening and to open said container inlet and allow liquid product to fill said container; and
(f) means located external to said fixed filling head to reseal said inlet.

7. A system as claimed in claim 6 wherein said conduit has a first opening sealed on its underside by said valve member which reciprocates between a position closing said first opening to a position adjacent a second opening at which the inlet opening means extends through said second opening to open said container inlet.

* * * * *

UNITED STATES PATENT AND TRADEMARK OFFICE

CERTIFICATE OF CORRECTION

PATENT NO. : 4,942,716

DATED : July 24, 1990

INVENTOR(S) : Ian McArthur Anderson

It is certified that error appears in the above-identified patent and that said Letters Patent is hereby corrected as shown below:

Column 1, line 44, "file" should be -- film --.

Column 3, line 5, after the word "the" insert -- continer inlet; --.

Column 3, line 41, after the word "thereto" insert -- during the operation of attaching the collar 8 to the container wall 2 --.

Signed and Sealed this

Seventeenth Day of September, 1991

*Attest:*

HARRY F. MANBECK, JR.

*Attesting Officer*

*Commissioner of Patents and Trademarks*